United States Patent [19]

Sanderson et al.

[11] Patent Number: 4,774,735

[45] Date of Patent: Oct. 4, 1988

[54] FOLDING CUSHION

[76] Inventors: William Sanderson, 1426 9th St., North, St. Petersburg, Fla. 33704; Michael Zinn, 3700 Bayshore Blvd., NE., St. Petersburg, Fla. 33703

[21] Appl. No.: 95,832

[22] Filed: Sep. 14, 1987

[51] Int. Cl.[4] ..... A47K 11/02

[52] U.S. Cl. ..... 5/449; 297/DIG. 3

[58] Field of Search ..... 5/449, 455, 435, 441, 5/417; 441/129, 135; 297/DIG. 3; 410/119; 114/345

[56] References Cited

U.S. PATENT DOCUMENTS

| | | | |
|---|---|---|---|
| 2,896,227 | 7/1959 | Reed | 5/441 |
| 2,990,070 | 6/1961 | Cushman | 410/119 |
| 3,008,214 | 11/1961 | Foster et al. | 297/DIG. 3 X |
| 3,251,077 | 5/1966 | Beckman | 297/DIG. 3 X |
| 4,071,031 | 1/1978 | Lowman | 5/441 X |
| 4,389,961 | 6/1983 | Parish | 114/345 |
| 4,405,129 | 9/1983 | Stuckey | 5/441 X |
| 4,594,743 | 6/1986 | Owen | 5/449 X |
| 4,644,597 | 2/1987 | Walker | 5/449 |

*Primary Examiner*—J. Franklin Foss

*Attorney, Agent, or Firm*—Frijouf, Rust & Pyle

[57] ABSTRACT

An inflatable and deflatable cushion comprising an inflatable chamber to receive an inflating fluid and further including a plurality of folding means positioned on the cushion for providing a plurality of hinge lines is disclosed. Upon deflation of the cushion, the cushion collapses to enable folding along the hinge lines to enhance the flattening of the deflated cushion and to enable the repeated folding of the cushion into a defined configuration and a small size for easy storage. A valve means permits fluid communication into the chamber to define an inflated cushion and further permits fluid communication out of the chamber in order to provide a collapsed and deflated cushion. The valve means further includes a sound generating means activated by the inflating medium when the cushion is being deflated.

27 Claims, 4 Drawing Sheets

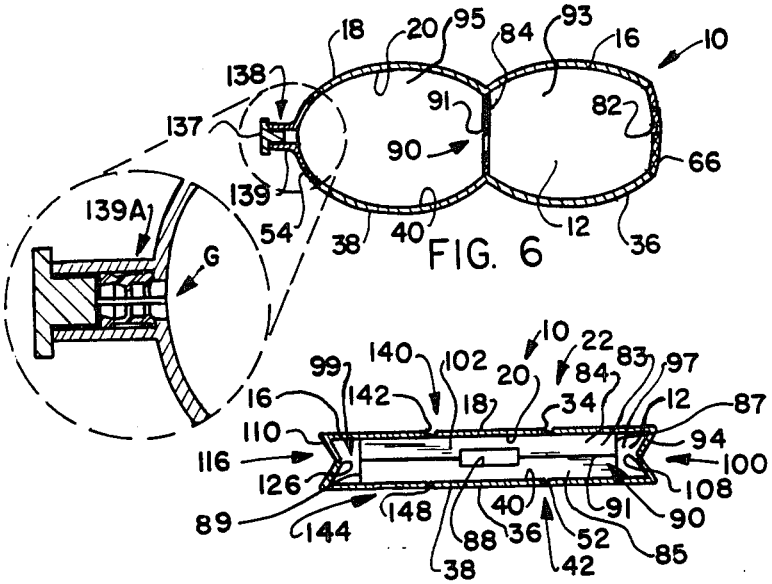
FIG. 6
FIG. 7
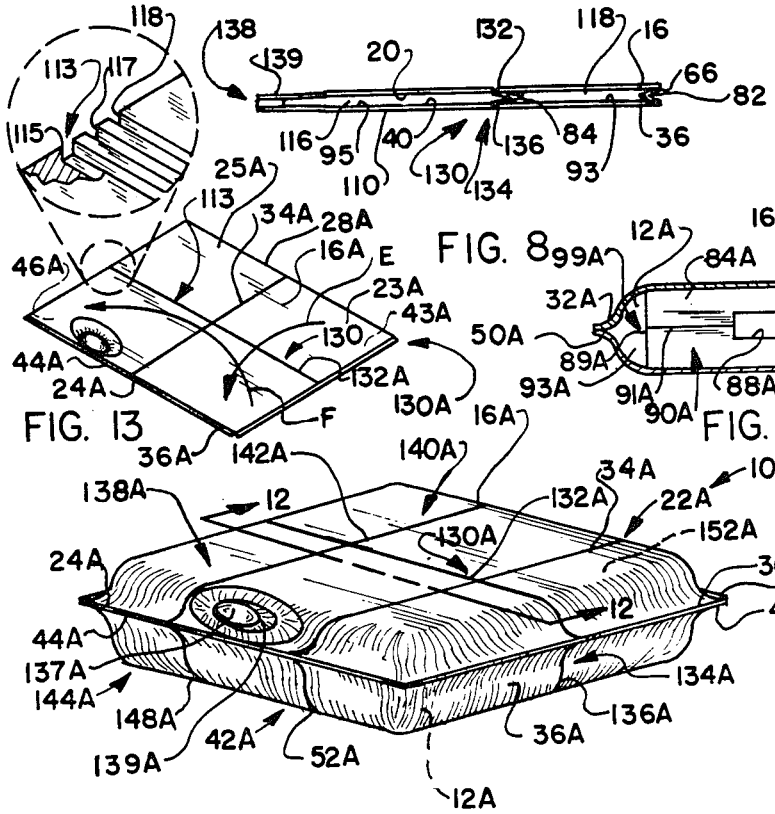
FIG. 8
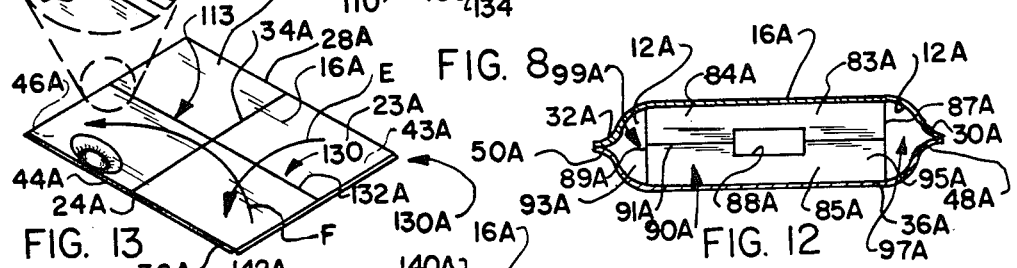
FIG. 12
FIG. 13
FIG. 9

FOLDING CUSHION

BACKGROUND OF THE INVENTION

1. Field of the Invention

This invention relates to an inflatable cushion and more particularly to a cushion which is foldable along folding means to permit easy deflated storage and portability.

2. Information Disclosure Statement

The prior art provides inflatable cushions which, once inflated, seemingly defy easy deflection into a flat and foldable condition. Thus, the storage of present inflatable cushions, and the like, requires more volume than would be required if the inflatable cushion could be essentially deflated of the inflating fluid and folded.

What is needed is an inflatable cushion which provides for easy and substantially complete removal of the inflating fluid.

It is a primary object of the invention to provide an inflatable cushion which is foldable along folding means to permit easy deflated portability and storage.

It is a further object of the invention to provide a folding means which provides hinge lines which enhance the removal of the inflating fluid when the cushion is being deflated.

It is a further object of the invention to provide a folding means positioned in the side interconnecting members and back member which promotes a collapsed state when deflated.

It is a further object of the invention to provide a cushion which upon deflation can be repeatedly folded along hinge lines to consistently form a small folded cushion after each inflation.

It is a further object of the invention to provide an inflatable cushion which may be deflated and easily folded into a flat and storable condition.

It is a further object of the invention to provide an inflatable cushion having folding means which provide hinge lines along which the memory of the plastic material comprising the inflatable cushion is enhanced to enable easy and repeatable folding of the inflatable cushion along the folding means when in a deflated state.

It is a further object of the invention to provide an inflatable cushion which attains and maintains a flat and compressed storable state when deflated and folded along the memory enhanced folding means.

It is a further object of the invention to provide a portable and inflatable cushion which is easily inflated to form a cushion suitable for sitting.

It is a further object of the invention to provide an inflatable cushion which includes advertising indicia disposed thereon for advertising a product, service or the like.

It is a further object of the invention to provide an inflatable cushion with a valve means including a sound generating means activated by the inflating fluid when the cushion is being deflated.

It is a further object of the invention to provide an inflatable cushion with folding means which provide hinge lines for enhancing the folding memory along the hinge line to enable an aligned foldable cushion when the cushion is in a collapsed and deflated condition.

The foregoing has outlined some of the more pertinent objects of the present invention. These objects should be construed to be merely illustrative of some of the more pertinent features and application of the invention. Many other beneficial results can be attained by applying the disclosed invention in a different manner or modifying the invention within the scope of the invention. Accordingly, other objects and a fuller understanding of the invention may be had by referring to the summary of the invention and the detailed description the preferred embodiments in addition to the scope of the invention defined by the claims take in conjunction with the accompanying drawings.

SUMMARY OF THE INVENTION

An inflatable, deflatable and foldable cushion of the present invention is defined by the appended claims with a specific embodiment shown in the figures. For purposes of summarizing the invention, the invention relates to an inflatable, deflatable and foldable cushion comprising a first and a second plastic sheet member with the first and the second plastic sheet members each having a front edge, a back edge, a first side edge and a second side edge. The front edges, back edges, first side edges and second side edges of the first and the second plastic sheet members, respectively, are sealed together in order to provide a fluid tight chamber between the first and second plastic sheet members. The fluid tight chamber in use receives an inflating fluid, such as air or the like. A first folding means extends from the front edge to the back edge of the first plastic sheet member. The first folding means divides the first plastic sheet member into a first portion and a second portion and further provides a first hinge line on the first plastic sheet member. The first hinge line extends from the front edge to the back edge of the first plastic sheet member. A second folding means extends from the front edge to the back edge of the second sheet member to divide the second plastic sheet member into a first portion and a second portion and further provides a second hinge line on the second plastic sheet member. The second hinge line preferably extends from the front edge to the back edge of the second plastic sheet member. A first transverse folding means extends from the first side edge to the second side edge of the first plastic sheet member. The first transverse folding means further provides a first transverse hinge line on the first plastic sheet member normal to the first hinge line. Preferably, the first transverse hinge line extends from the first side edge to the second side edge of the first plastic sheet member. A second transverse folding means extends from the first side edge to the second side edge of the second plastic sheet member. The second transverse folding means provides a second transverse hinge line on the second plastic sheet member normal to the second hinge line. A valve means is positioned in one of the first and second plastic sheet members. The valve means permits fluid communication into the chamber to define an inflated cushion and also permits fluid communication out of the chamber in order to provide a collapsed and deflated cushion. The collapsed and deflated cushion enables the each folding means to be simultaneously folded along the respective hinge lines. Thus, the first folding means and second folding means of the first and second plastic members, respectively, may be simultaneously folded along the first hinge line and second hinge line, respectively, such that the first side edges become proximate the second side edges of the first and second plastic sheet members. This folding maneuver forms a flat, partially folded and deflated inflatable cushion and further enables the first transverse folding means and the second transverse folding means to be simultaneously folded such that the back edges of the first and second plastic members become proximate the front edges of the first and second plastic sheet members to form a flat, completely folded and deflated inflated cushion.

Preferably, the cushion further includes a partition member disposed within the chamber to form a proximate chamber and a distal chamber. The partition further includes a first end, a second end, a third end and a fourth end. The first end and second end of the partition member sealingly interconnect each first and second sheet members, respectively. The attached partition member maintains the parallel relationship of the first and second plastic sheet members when the cushion is inflated. Preferably, the partition member further includes an aperture formed in the partition to enhance fluid communication of the inflating fluid between the proximate chamber and the distal chamber of the chamber. Preferably, the partition member includes a sixth folding means which extends from the third end to the fourth end of the partition member. The sixth folding means of the partition member enhances the collapsibility of the cushion. Preferably the folding means which includes the first folding means, second folding means, first transverse folding means, second transverse folding means and sixth folding means eah comprise a channel formed in the surface of the first and second plastic sheet members to enhance the folding memory of the first and second sheet members. Preferably, the sixth folding means comprises a channel formed in the surface of the partition member to further enhance the collapsibility of the first sheet member and second sheet member when the cushion is being deflated.

In a further embodiment of the invention comprises a first and a second plastic sheet member having an outer surface and an inner surface. The first and second plastic sheet members each further include a front edge, a back edge, a first side edge and a second side edge. A front interconnecting member having a first end, a second end, a third end, and a fourth end is disclosed. The first end and second end of the front interconnecting member sealingly interconnects the front edges of each of the first and second plastic sheet members, respectively. The sealed interconnection can be made by methods known in the art such as thermal welding. A back interconnecting member with a first end, a second end, a third end, and a fourth end is disclosed. The first end and second end of the back interconnecting member sealingly interconnects the back edges of each of the first and second plastic sheet members, respectively. A first interconnecting member with a first end, second end, third end and fourth end is disclosed. The first end and second end of the first interconnecting member sealingly interconnect each first side edges of the first and second plastic sheet members, respectively. A second interconnecting member with a first end, a second end, a third end and a fourth end is disclosed. The first end and second end of the second interconnecting member sealingly interconnect each second side edge of each first and second plastic sheet members, respectively. The third end of the front interconnecting member is sealingly interconnected with the third end of the first interconnecting member. The fourth end of the first interconnecting member is sealingly interconnected with the third end of the back interconnecting member. The fourth end of the back interconnecting member is sealingly interconnected with the fourth end of the second interconnecting member. The third end of the second interconnecting member is sealingly interconnected with the fourth end of the front interconnecting member such that when inflated, the inner surfaces of the first and second plastic sheet members are in a substantially parallel spaced relationship and said front interconnecting member and the back interconnecting member are in a substantially and parallel and spaced relationship and the first and second interconnecting members are in a substantially parallel and spaced relationship to define a fluid tight chamber to receive an inflating fluid. A third folding means provides a third hinge line which is disposed on a back interconnecting member. The third folding means extends from the third end of the back interconnecting member to the fourth end of the back interconnecting member. Preferably the third hinge line extends from the third end of the back interconnecting member to the fourth end of the back interconnecting member. A fourth folding means for providing a fourth hinge line is disposed on the first interconnecting member and extends from the third end of the first interconnecting member to the fourth end of the first interconnecting member. A fifth holding means is disposed on the second interconnecting member and extends from the third end of the second interconnecting member to the fourth end of the interconnecting member to form a fifth hinge line such that upon deflation of the cushion, the third, fourth and fifth folding means permit the collapse of the inner surface of the first plastic sheet member onto the inner surface of the second plastic sheet member thereby forming a flat and collapsed cushion. A first folding means which extends from the front edge to the back edge of the first plastic sheet member divides the first plastic sheet member into a first portion and a second portion and further provides a first hinge line on the first plastic sheet member. preferably, the first hinge line extends from the front edge to the back edge of the first plastic sheet member. A second folding means extends from the front edge to the back edge of the second plastic sheet member to divide the second plastic sheet member into a first portion and a second portion. The second folding means further provides a second hinge line on the second plastic sheet member to enable the first portion of the first and second plastic sheet members to be simultaneously folded along the first and second hinge lines of the first and second plastic sheet members, respectively, such that the first side edges of the first and second plastic sheet members become proximate the second side edges of the first and second plastic sheet members to thereby form a flat, partially folded and deflated cushion. A first transverse folding means extends from the first side edge to the second side edge of the first plastic sheet member. The first transverse folding means further provides for a first transverse hinge line on the first plastic sheet member normal to the first hinge line. A second transverse folding means extends from the first side edge to the second side edge of the second plastic sheet member. The second transverse folding means further for a second transverse hinge line on the second plastic sheet member normal to the second hinge line such that in use the first and second transverse hinge line may be simultaneously folded to enable the back edges of the first and second plastic sheet members to become proxomate the front edges of the first and second sheet members to form a flat, completely folded and deflated inflatable cushion. A valve means for permiting fluid communication into a chamber to define an inflated cushion and for further permitting fluid communication out of the chamber in order to provide a collapsed and deflated cushion such that the first and second sheet members collapse to define a deflated, flat cushion.

Preferably, the cushion further includes a partition member disposed within the chamber to form a proximate chamber and a distal chamber. The partition member further includes a first end, a second end, a third end and a fourth end. The first end and second end of the partition member sealingly interconnect the first and second sheet members, respectively, for maintaining the parallel relationship of the first and second sheet members when the cushion is inflated. Preferably, the partition further includes an aperture formed therein to enhance fluid communication of the inflating fluid between the proximal chamber and the distal chamber of the chamber. Preferably, the partition further includes a sixth folding means disposed on the partition member and extending from the third end to the fourth end in order to enhance the collapsibility of the cushion is considered the extent with which the inner surface of the first sheet member collapses upon the inner surface of the second sheet member. Preferably, the partition further includes a first and a second notch formed at the third end and fourth end, respectively, for receiving in use a portion of the first interconnecting member and second interconnecting member proximate the third end and fourth end of the partition, respectively, when the cushion is being deflated. The first and second notches enhance the flatness of the cushion when completely collapsed and deflated. The first and second notches receive the plastic material of the first and second interconnecting member which is proximate the third end and fourth end of the partition member. The reception of the plastic material by the first and second notches enhances the flatness of the cushion when completely collapsed and deflated. Preferably, the partition member is parallel to and attachedly sealed to the first and second sheet members proximate the first and second transverse hinge lines.

Preferably the third folding means, fourth folding means and fifth folding means are disposed on the outer surface of the back interconnecting member, the first interconnecting member and second interconnecting member, respectively, to enhance the inwardly foldability of the back interconnecting member, the interconnecting member and the second interconnecting member to enhance the flatness of the cushion when in a deflated state.

In a further embodiment, the cushion further includes the first folding means being disposed on the outer surface of the first plastic sheet member and the second folding means being disposed on the inner surface of the second plastic sheet member to enhance the foldability of the first portions of the first and second plastic sheet members along the hinge lines of the first and second plastic sheet members. In a further embodiment of the invention, the folding means further includes a plurality of hinge lines juxtapositioned to enhanced foldability along the hinge lines. The plurality of hinge lines is most useful where the sheet and interconnecting members are relatively thick. Thus, each folding means, as described above, optionally includes a plurality of channels to form each hinge line formed in the interconnecting, partition, and sheet members to further enhance collapsibility and foldability of the cushion. The number of channels which comprise the plurality of channels is related to the thickness of the sheet material of the member the channels are formed in. Thus, the thicker the sheet material, the greater the number of channels required.

In a further embodiment of the invention, the first folding means which provides the first hinge line is a first channel formed on the outer surface of the first plastic sheet member and the second folding means which provides the second hinge line is a second channel formed on the inner surface of the second sheet member. The positioning of the first channel and the second channel in the outer and inner surfaces respectively further enhances the foldability of the cushion when the first portions of the first and second sheet members are simultaneously folded along the first and second hinge lines of the first and second sheet members, respectively. This enables the first side edges of the first and second plastic members to become proximate the second side edges of the first and second plastic sheet members without resistance along the hinge lines to thereby form a flat, partially folded and deflated cushion. Preferably, the first and second channels run from the first side edge to the second side edge of each of the first and second sheet members, respectively.

Preferably, the third, fourth and fifth folding means which provide the third, fourth and fifth hinge lines are a third, a fourth and a fifth channel formed on the outer surface of the back interconnecting member, the first interconnecting member and the second interconnecting member, respectively. The channels provide better memory retention to augment the foldability of the cushion along the hinge lines to inwardly bias the interconnecting and sheet members when the cushion is being deflated.

In a further embodiment of the invention, the first and second plastic sheet members further include a seventh and an eighth folding means, respectively. The seventh folding means is parallel and spaced apart relative to the first folding means and further provides for a seventh hinge line which extends from the front edge to the back edge of the first plastic sheet member. The seventh folding means and the first folding means together divide the first sheet member into a first portion, a second portion and a third portion. An eighth folding means is parallel and spaced apart relative to the second folding means and further provides an eight hinge line which extends from the front edge to the back edge of the second plastic sheet member. The eighth folding means and second folding means divide the second plastic sheet member into a first portion, a second portion and a third portion to enable the first portion of the first and second plastic sheet members to be simultaneously folded along the first and second hinge lines provided by the first and second folding means such that the first side edges of the first and second plastic sheet members become proximate the seventh hinge line of the first plastic sheet member and to further enable the third portions of the first and second plastic sheet members to be simultaneously folded along the seventh and eighth hinge lines provided by the seventh and eighth hinge lines such that the side edges of the first and second plastic sheet members become proximate the second hinge line provided by the second folding means of the second sheet member. Preferably, the seventh folding means is a channel formed on the outer surface of the first plastic sheet member. The eighth folding means is preferably a channel formed on the inner surface of the second plastic sheet member to enable the third portions of the first and second plastic sheet members to be simultaneously folded along the seventh and eighth hinge lines provided by the seventh and eighth folding means such that the side edges of the first and second plastic sheet member become proximate the second hinge line provided by the second folding means of the second sheet member.

The cushion of the invention further may include a valve means which comprises a sound generating means activated by the inflating fluid when the cushion is being deflated.

Preferably the third end and fourth end of the front interconnecting member, the back interconnecting member and the first interconnecting member and second interconnecting member are concavely shaped to further enhance the inwardly folding direction or bias of the back interconnecting member, first interconnecting member and second interconnecting member.

The hinge lines present on the first and second sheet members and the front, back, first and second interconnecting members enhance the folding memory of the members along the hinge line. The hinge lines enable the deflected and flattened cushion to be easily refolded into the original and compact dimension. In the first embodiment, the hinge lines present in the back, first and second interconnecting members (third, fourth and fifth hinge lines, respectively), (and partition member, if present, with a sixth hinge line) enable the hinge lines in the first and second sheet members to be aligned for easy and rapid folding upon collapsement of the first sheet member onto the second sheet member. Thus, the third, fourth, fifth and sixth, (if present) hinge lines enable the first sheet member to alignedly collapse downwardly over the second sheet member, such that upon deflation, the first hinge line is alignedly positioned over the second hinge line and contacts the second hinge line; the seventh hinge line is alignedly positioned over the eighth hinge line and contacts the eighth hinge line and the first transverse hinge line is alignedly positioned over the second transverse hinge line and contacts the second transverse hinge line. Accordingly, deflation provides paired hinge lines: first-second, seventh-eighth of the first and second sheet members and first transverse-second transverse which enable fast and accurate folding of the deflated cushion.

Preferably, the first and second portions are equal in size. In those cushions with first, second and third portions, it is preferred that the portions are equal in size. Equal portion sizes provide for the overlying and underlying folding means to be in, or substantially in, the same plane thereby insuring simultaneous folding. Preferably, the transverse hinge lines equally divide the sheet members. The number of folding means which provide transverse hinge lines on the sheet members is determined by the size of the sheet members in relationship to the desired size once folded as practically attainable.

Preferably, the folding means which provide the hinge lines are a channel formed in the surface of the plastic sheet members and the interconnecting members to enhance the folding memory of the sheet members and interconnecting members, respectively. The channel may be formed by "hot stamping" into the surface of the members a melted channel which partially extends into the thickness of the member. The channel forming device includes a heated bar seal die which contacts the surface of the member (plastic sheet) and utilizes radio frequency to form the channel. Other methods of forming folding means are known to those skilled in the art once given the disclosure of this invention. For example, the use of two plastic sheets with their surfaces adhered to one another except at the folding means where a gap occurs in one of the sheets to form a channel comprise an alternative method.

The ends of the interconnecting members and the edges of the sheet members may be sealed or joined together by sonic welding, heat sealing, adhesives, or the like by methods well known in the art to form the desired chamber.

A hold down means is preferably attached to the device such that when the device is folded, the hold down means secures and maintains the cushion in the folded position. Hold down means include hooks and loops (VELCRO), snaps, or the like, well known in the art.

The composition of the first and second plastic sheet members and the interconnecting members may be of any flexible material, such as vinyl, which is also capable of holding and containing an inflating medium, such as air. Such materials are known to those in the industry to be useful in the production of inflatable devices and which can also accept folding means as described herein. The composition of the partition member should be of the same material as the sheet and interconnecting members. However, the partition member does not require the ability of containing the inflating medium.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 6 is a sectional view taken along the line 6—6 of FIG. 1;

FIG. 7 is a sectional view taken along the line 7—7 of FIG. 4;

FIG. 8 is a sectional view taken along the line 8—8 of FIG. 5;

FIG. 9 is an isometric view of a second embodiment of the folding cushion of the invention in an inflated condition;

FIG. 12 is a sectional view taken along line 12—12 of FIG. 9;

FIG. 13 illustrates the folding steps in folding the deflated cushion of the invention.

Similar reference characters refer to similar parts throughout the several views of the drawings.

DETAILED DISCUSSION

Figure 1:
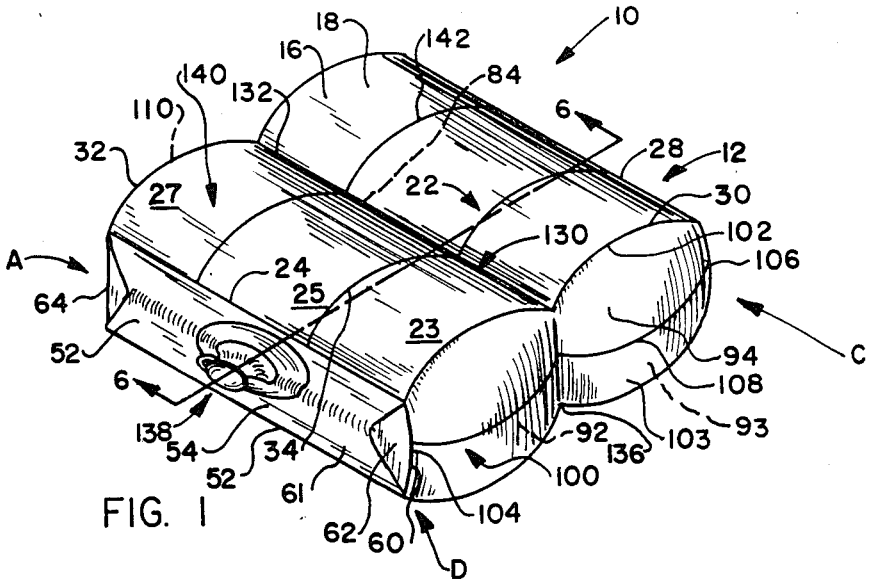
FIG. 1 is an isometric view of the folding cushion of the invention in an inflated condition.
Figure 2:
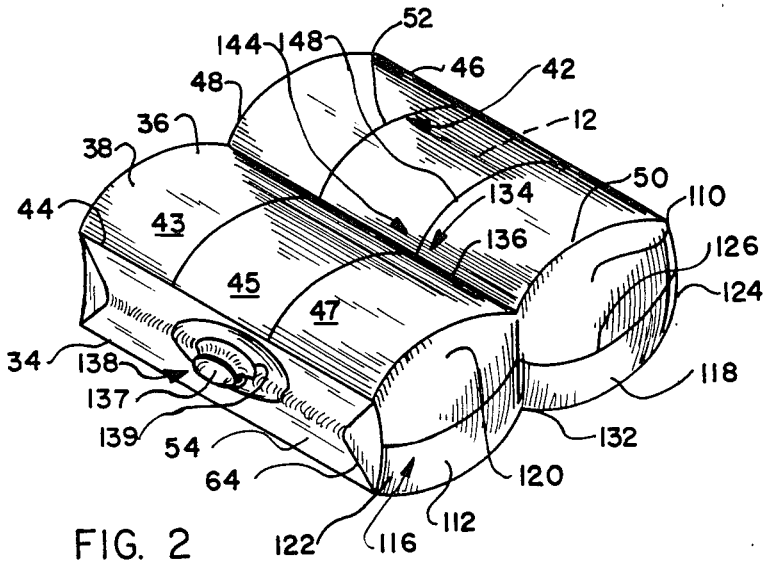
FIG. 2 is an isometric view of the bottom portion of the folding cushion of FIG. 1 in an inflated condition.

FIG. 1 is an isometric view of the folding pillow apparatus 10 comprising a first sheet member 16 having an outer surface 18 and an inner surface 20. A first folding means 22 is disposed on the first sheet member 16. The first sheet member 16 further includes a front edge 24, a back edge 28, a first side edge 30 and a second side edge 32. The first folding means 22 extends from the front edge 24 of the first sheet member 16 to the back edge 28 of the first sheet member 16. The first sheet member 16 is divided by the first folding means 22 into a first portion 23 and a second portion 25. Furthermore, the first folding means 22 provides a first hinge line 34 which extends from the front edge 24 to the back edge 28 of the first sheet member 16. A second folding means 42 is disposed on the second sheet member 36 and extends from the front edge 44 to the back edge 46 of the second plastic sheet member 36 as shown at FIG. 2. The second folding means 42 divides the second sheet member 36 into a first portion 43 and a second portion 45. The second sheet member 36 includes an outer surface 38 and an inner surface 40, a first side edge 48 and a second side edge 50 with the front edge 44 and the back edge 46 as described above. The second folding means 42 provides a second hinge line 52 which extends from the front edge 44 to the back edge 46 of the second sheet member 36. A seventh folding means 140 provides a seventh hinge line 142 and further divides the first sheet member 16 and provides a third portion 27. A first transverse folding means 130 extends from the first side edge 30 to the second side edge 32 of the first sheet member 16. The first transverse folding means 130 provides a first transverse hinge line 132 which is positioned on said first plastic sheet member 16 normal to the first hinge line 34. A second transverse folding means 134 extends from the first side edge 48 to the second side edge 50 and provides a second transverse hinge line 136 as shown at FIG. 2. The second transverse hinge 136 is normal to the second hinge line 52 on the second sheet member 36. A first interconnecting member 94 having a first end 102 is sealingly connected to the first side edge 30 of the first sheet member 16. The second end 103 of the first interconnecting member 94 is sealingly connected to the first side edge 48 of the second sheet member 36. The third end 104 of the first interconnecting member 94 is sealingly connected to the third end 62 of the front interconnecting member 54. A fourth folding means 100 extends from the third end 104 to the fourth end 106 of the first interconnecting member 94. The fourth folding means 100 is disposed on the first interconnecting member 94 and provides a fourth hinge line 108.

The first transverse hinge line 132 and second transverse hinge line 136 are positioned in the same plane such that when the pillow is deflated the first 16 and second 36 sheet members collapse enabling hinge line 132 to alignedly contact hinge line 136. This enables the simultaneous folding of transverse hinge lines 132, 136 to enable the front edges 24, 44 of the first 16 and second 36 sheet members, respectively, to be positioned proximate the back edge 28, 46 of the first 16 and second 36 sheet members, respectively. When the cushion has been folded as indicated at FIG. 11C this maneuver forms the flat completely folded and deflated cushion according to the invention 10.

A valve means 138 is positioned in the front interconnecting member 54. When inflated the first 16 and second 36 plastic sheet members are in a substantially parallel spaced apart relationship and the front interconnecting member and back interconnecting member 54, 66, respectively, are in a substantially parallel and spaced apart relationship and the first and second interconnecting members 94, 110 respectively, are in a substantially parallel and spaced apart relationship to define a fluid tight chamber 12 to receive an inflating fluid. The valve means 138 permits fluid communication with an inflating medium such as air into the chamber 12. Once inflated, the valve cap 137 is sealingly positioned into the valve body 139 to prevent the loss of the inflating medium. In order to provide a collapsed, deflated cushion such that the first 16 and second 36 sheet members collapse to define a deflated, flat cushion, the valve cap 137 is removed from the valve body 139 to permit the release of the inflating medium from the chamber 12.

FIG. 2 is an isometric view of the apparatus of the invention "flipped-over" in order that certain structural appearances not visible in FIG. 1 are made visible. FIG. 2 illustrates the second interconnecting member 110 with the first end 118 connected to the second side edge 32 of the first sheet member 16. The second end 120 of the second interconnecting member 110 is sealingly connected to the second side edge 50 of the second sheet member 36. The third end 122 of the second interconnecting member 110 is sealingly connected to the fourth end 64 of the front interconnecting member 54. The fourth end 124 of the second interconnecting member 110 is sealingly connected to the fourth 80 end of the back interconnecting member 66. A fifth folding means 116 extends from the third end 122 to the fourth end 124 of the second interconnecting member 110. The fifth folding means 116 disposed on the second interconnecting member 110 provides a fifth hinge line 126.

The second folding means 42 divides the second sheet member 36 into a first portion 43 and a second portion 45. An eighth folding means 144 provides an eighth hinge line 148 and further divides the second sheet member 36 and provides a third portion 47.

Figure 3:
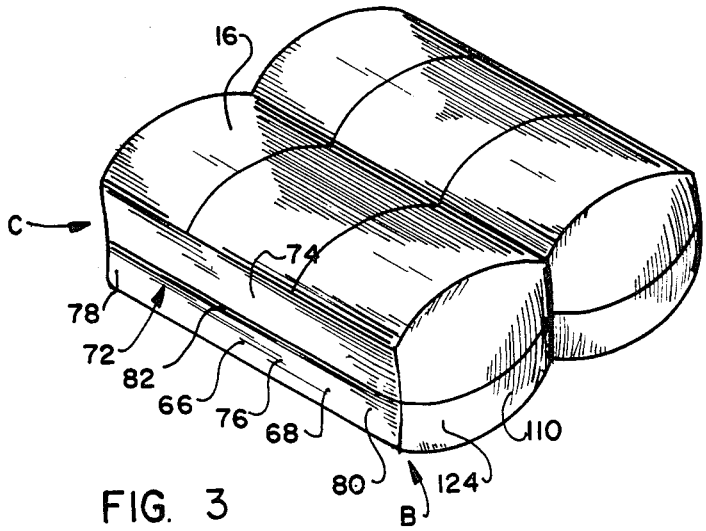
FIG. 3 is an isometric view of the back portion of the folding cushion of FIG. 1 in an inflated condition.

FIG. 3 is a rear view of FIG. 2. FIG. 3 illustrates the back interconnecting member 66 with the third and fourth ends 78, 80 respectively, being concavely shaped. The concave shape results from concavely shaping the third end 78 and fourth end 80 of the back interconnecting member 66 and the fourth end 106 of the first interconnecting member 94 and the fourth end 124 of the second interconnecting member 110. The concavely shaped corners B and C further enhance an inwardly direction of the back interconnecting member 110 during deflation. The outward flow of the inflating medium through valve 138 enhances the outward direction of the front interconnecting member 54 as the cushion is being deflated.

Figure 4:
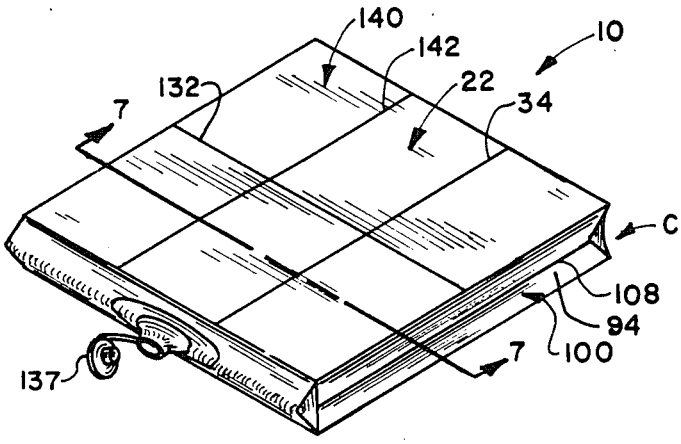
FIG. 4 is an isometric view of the folding cushion of FIG. 1 in a partially deflated condition.

FIG. 4 illustrates the apparatus of the invention in a partially collapsed condition. As illustrated, the cushion of the invention is collapsing along the fourth hinge line 108 of the first interconnecting member 94, fifth hinge line 126 of the second interconnecting member 110, the third hinge line 82 of the back interconnecting member 66 and the sixth hinge line 91 of the partition member 84, respectively.

Figure 5:
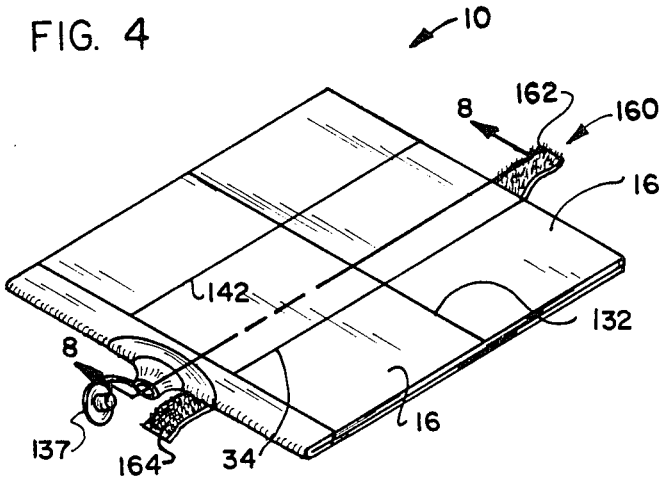
FIG. 5 is an isometric view of the folding cushion of FIG. 1 in a completely deflated and collapsed condition prior to folding.

FIG. 5 illustrates the cushion of the invention 10 in a completely collapsed condition with valve cap 137 removed from valve body 139 to enable the inflating medium to exit. In such condition the inner surface 20 of the first sheet member 16 is collapsed upon the inner surface 40 of the second sheet member 36. Hold down means 160 comprises loops 162 and hooks 164 for maintaining the collapsed and folded cushion in such conditions as at FIG. 11E. Hold down means 160 are set forth in FIGS. 5, 11C and 11D in order to simplify the drawings.

FIG. 6 is a sectional view taken along the line 6—6 of FIG. 1. As illustrated the valve means 138 includes a valve cap 137 sealingly engaging valve body 139. The valve body 139 may further include a resonance means 139A to generate sound. Such sound generating means, for example a whistle, are known in the art. Preferably, partition member 84 divides the fluid tight chamber 12 into a proximate chamber 95 and a distal chamber 93.

FIG. 7 is a sectional view taken along the line 7—7 of FIG. 4. FIG. 7 illustrates the partition member 84 with an aperture 88 formed therein. The aperture 88 enhances the movement of the inflating fluid between a proximate chamber 95 and a distal chamber 93. Partition member further includes a first end 83, a second end 85, a third end 87 and a fourth end 89. A sixth folding means 90 is formed on partition member 84. Preferably, the sixth folding means 90 includes a sixth hinge line 91 which extends from the third end 87 to the fourth end 89 of the partition member 84. However, the hinge line 91 is not necessary along the length of aperture 88 as illustrated at FIG. 7.

The first folding means 22 and seventh folding means 140 are disposed on the first sheet member 16. The second folding means 42 and eighth folding means 144 are disposed on the second sheet member 36. The first 34 and seventh 142 hinge lines are positioned adjacent to each other and are substantially parallel to each other. The second 52 and eighth 148 hinge lines are likewise positioned. The first hinge line 34 is positioned directly over the second hinge line 52. In a like manner, the seventh hinge line 142 is positioned directly over the eight hinge line 148. This enables the simultaneous folding of the first and second hinge lines when the cusion is in a collapsed condition. Likewise, the overhead positioning of the seventh hinge line 142 relative to the eighth hinge line 148 enhances the simultaneous folding of each of the mentioned hinge lines. Preferably, the eighth folding means 144 which provides a hinge line 148 is formed on the inner surface 40 of the second sheet member 36. In like manner, the second folding means 42 of the second sheet member 36 is formed in the inner surface 40 of the second sheet member 36. Whereas, the seventh folding means 140 and first folding means 22 which provide the seventh hinge line 142 and first hinge line 34, respectively, are formed in the outer surface 18 of the first sheet member 16. Partition member 84 further includes a first 97 and a second 99 notch formed at the third end 87 and fourth end 89, respectively, for receiving in use a portion of the first interconnecting member 94 and second interconnecting member 110 proximate the third end 87 and fourth end 89 of the partition 84, respectively, when the cushion is being deflated. The first 97 and second 99 notches enhance the flatness of the cushion 10 when completely collapsed and deflated. The exploded portion of FIG. 6 illustrates the sound generating means with the cap 137 removed from the valve body 139 to permit air indicated by arrows "G" to exit therethrough and to produce a sound.

FIG. 8 is a sectional view taken along line 8—8 of FIG. 5. The deflated cushion of FIG. 8 illustrates the collapsed position of the first sheet member 16 relative to the second sheet member 36 prior to folding the cushion along transverse hinge lines 132, 136. Partition member 84 and back interconnecting member 66 are folded along their respective hinge lines 91, 82.

FIG. 9 is an isometric view of a second embodiment of the invention 10A. Equivalent parts of the second embodiment are labelled with similar numbers as equivalent parts of the first embodiment but with the addition of the suffix "A" in order to distinguish the embodiments. This alternative embodiment comprises a first plastic sheet member 16A and a second plastic sheet member 36A. The first plastic sheet member 16A and second plastic sheet member 36A are sealed together at the edges thereof to provide an inflatable cushion 10A. More particularly the front edges 24A and 44A, the back edges 28A, 46A, the first side edges 30A and 48A and the second side edges 32A and 50A of the first and second plastic sheet members 16A, 36A, respectively, are sealed together by means known in the art such as sonic welding. The sealing of the edges of the first plastic sheet member 16A and the second plastic sheet members 36A forms a chamber 12A for receiving an inflating fluid. A valve means 138A is positioned in either the first plastic sheet member 16A or the second plastic sheet member 36A to provide fluid communication with the chamber 12A. Preferably, valve means 138A is a valve body 139A which cooperates with valve cap 137A to control the flow of the inflating medium into or out of chamber 12A of the cushion 10A.

Figure 10:
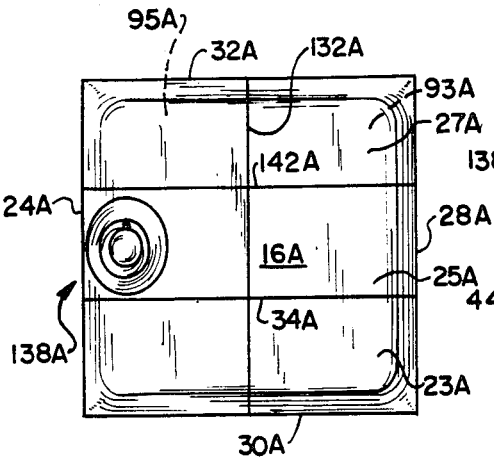
FIG. 10 is a top view of the second embodiment.

FIG. 10 is a top view of the second embodiment. FIG. 10 illustrates the position of the first hinge line 34A, the seventh hinge line 142A and the first transverse hinge line 132A on the first plastic sheet member 16A. A valve means 138A is positioned proximate the front edge 24A of the first plastic sheet members 16A. Positioning hinge lines 34A and 142A on first sheet member 16A divides first sheet member into a first portion 23A, a second portion 25A, and a third portion 27A.

Figure 10A:
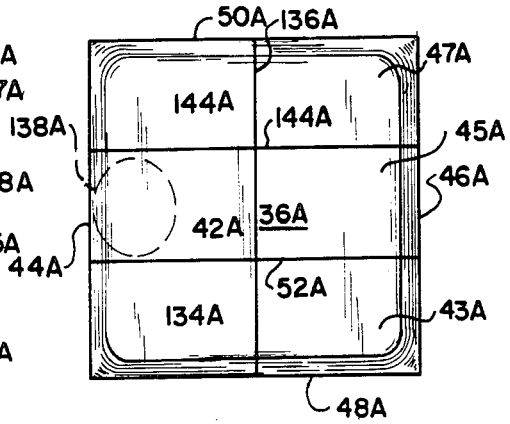
FIG. 10A is a bottom view of FIG. 10.

FIG. 10A is a bottom view of FIG. 10 illustrating the second hinge line 52A, the eighth hinge line 144A and the second transverse hinge line 136A on the second plastic sheet member 36A. Positioning hinge lines 52A and 144A divides second sheet member 36A into a first portion 43A, a second portion 45A, and a third portion 47A.

Figure 11A:
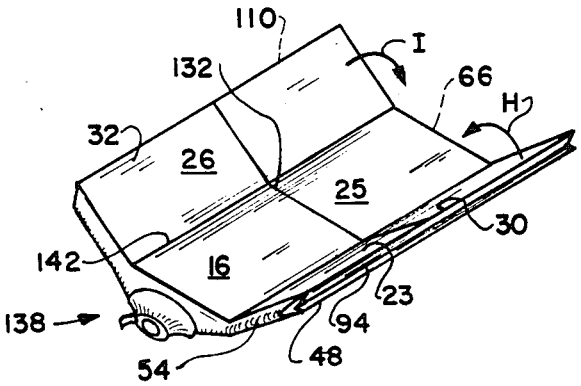
FIG. 11A illustrates the first folding steps in folding the deflated cushion of the first embodiment.

FIG. 11A illustrates the first folding steps in folding the deflated cushion of the first embodiment. The folding steps for the second embodiment are essentially the same as the first embodiment once the cushion is in a deflated and collapsed condition. Prior to folding the cushion, it appears as illustrated at FIG. 5. The first fold step is obtained by simultaneously folding the cushion along the first 34 and second 52 hinge lines such that the first side edges 30,48 of the first and second plastic sheet members 16,36 respectively, are proximate and along the seventh hinge line 142 of the first plastic sheet member 16. This maneuver is indicated by arrow "H". The second folding step positions the second side edges 32,50 of the first and second sheet members 16,36, respectively, proximate and along the second hinge line 52 of the second sheet member 36. This maneuver is indicated by arrow "I".

Figure 11B:
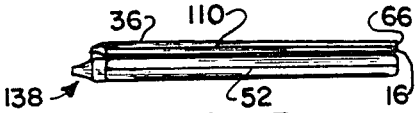
FIG. 11B illustrates the foldable cushion upon completion of the first folding steps.

FIG. 11B illustrates the foldable cushion with the second interconnecting means 110 proximate the second hinge line 52 of the second sheet member 36 as a result of the folding steps depicted at FIG. 11A.

FIG. 11C illustrates the final folding step, in process, where the first and second transverse hinge lines 132,136 are simultaneously folded such that the back interconnecting member 66 is positioned proximate the front interconnecting member 54.

Figure 11D:
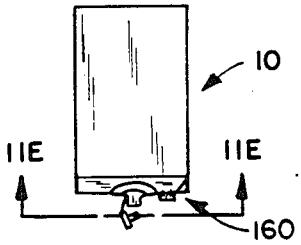
FIG. 11D illustrates the final folded cushion.
Figure 11C:
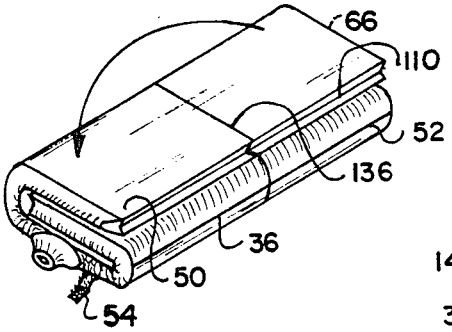
FIG. 11C illustrates the second folding step in progress.

FIG. 11D is completely folded cushion 10 which can be repeatably obtained after each inflation and subsequent deflation and folding.

Figure 11E:
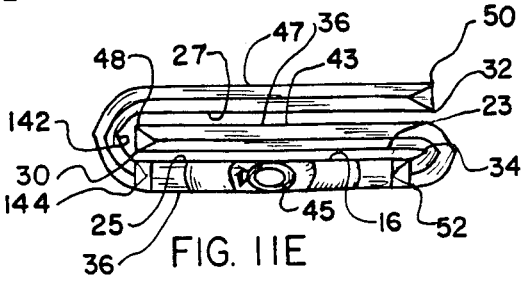
FIG. 11E illustrates a front view of FIG. 11C.

FIG. 11E illustrates the partially folded cushion with the third portion 27 of the first sheet member 16 proximate the first portion 43 of the second sheet member 36 and with the first portion 23 of the first sheet member proximate the second portion 25 of the first sheet member 16.

FIG. 12 is a sectional view taken along line 12—12 of FIG. 9. The partition member 84A further includes a first end 83A, a second end 85A, a third end 87A and a fourth end 89a. The first end 83A and second end 85A are sealingly interconnected to the first plastic sheet member 16A and second plastic sheet member 36A, respectively. The partition 84A maintains the parallel relationship of the first 16A and second 36A plastic sheet members when the chamber 12A of the cushion is inflated by the inflating fluid. Preferably, the partition member 84A further includes an aperture 88A to enhance fluid communication of the inflating fluid between the distal chamber 93A and proximate chamber 95A. The partition member 84A preferably includes a sixth folding means 90A which is formed on the partition member 84A. Preferably, the sixth folding means 90A includes a sixth hinge line 91A which extends from the third end 87A of the partition member to the fourth end 94A of the partition member. Preferably the sixth hinge line 91A is a channel formed in the partition member 84A. partition member 84A further includes a first 97A and a second 99A notch formed at the third end 87A and fourth end 89A thereof, respectively. The first 97A and second 99A notches enhance fluid communication between the proximal and distal cavities (not shown) thereby enhancing the flatness of the cushion 10A when completely collapsed and deflated.

FIG. 13 illustrates the folding steps of the folding cushion having a first portion 23A, 43A of the first and second plastic sheet members, respectively and a second portion 25A, 46A of the first and second plastic sheet members, respectively. The folding steps would be the same for the folding cushion of the first embodiment of the invention having first 23, 43 and second 25, 46 portions i.e., the embodiment of FIG. 1 without the seventh and eighth folding means, once the cushion was collapsed and deflated. Accordingly, the simultaneous folding of the first folding means 22A and the second folding means 42A along the first hinge line 34A and the second hinge line 52A of the first 16A and second 36A sheet members, respectively, such that the first side edges 30A, 48A of the first 16A and the second 36A plastic sheet members are proximate the second side edges 32A, 50A of the first 16A and the second 36A plastic sheet members results in the formation of a flat, partially folded and deflated inflatable cushion. Arrow "F" indicates this maneuver. The first transverse folding means 130A and the second transverse folding means 134A are then simultaneously folded along the first 132A and the second 136A transverse hinge lines, respectively, such that the back edges 28A, 46A of the first 16A and the second 36A plastic members are proximate the front edges 24A, 44A of the first 16A and the second 36A plastic sheet members to form a flat, completely folded and deflated inflatable cushion. Arrow "E" indicates this maneuver.

The folding sequence is not critical. Thus, the first and second hinge lines may be first folded, the seventh and eighth folded and the first and second transverse hinge lines folded last where the cushion has the first, second and third portions, as see FIG. 11A. The last folded folding means are preferably a plurality of channels such as the first and second transverse hinges lines. Also, the first and second hinge lines may be first folded and the first and second transverse hinge lines folded last where the cushions has only the first and second portions. The result is a consistently repeatable foldable cushion no matter whether folding of the transverse hinge lines is first or whether folding of the hinge lines normal or perpendicular to the transverse hinge lines are first. FIG. 13 also illustrates first transverse folding means 130A including a plurality of channels 113 forming a hinge line 132A. Each channel 115, 117, 119 of the plurality of channels 113 is adjacently spaced apart, parallel and proximate relative to another channel. The plurality of channels enhances the foldability of the first plastic sheet member 16A along the hinge line 132A. Where the fold encompasses a large number of sheet members, such as in the fold sequence illustrated in FIG. 11C, the transverse folding means preferably comprises a plurality of channels to enhance the foldability of the sheet members being folded.

Figure 13A:
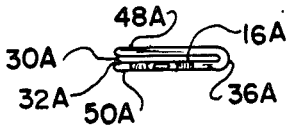
FIG. 13A illustrates a front view of FIG. 13 after the first folding maneuver according to arrow "F".

FIG. 13A illustrates the resulting folded cushion of FIG. 13 after folding along the first and second hinge lines and prior to folding along the first and second transverse hinge lines.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of construction and the combination and arrangement of parts may be restored to without departing from the spirit and scope of the invention

What is claimed is:

1. An inflatable, deflatable and foldable cushion comprising:

a first and a second plastic sheet member;

each said first and said second plastic sheet members having a front edge, a back edge, a first side edge and a second side edge;

said front edges, said back edges, said first side edges and said second side edges of said first and said second plastic sheet members, respectively, sealed together to provide a fluid tight chamber between said first and said second plastic sheet members to receive an inflating fluid;

a first folding means extending from said front edge to said back edge of said first plastic sheet member thereby dividing said first plastic sheet member into a first portion and a second portion and for providing a first hinge line on said first plastic sheet member to enhance the folding memory of said first plastic sheet member along said first hinge line;

a second folding means extending from said front edge to said back edge of said second plastic sheet member thereby dividing said second plastic sheet member into a first portion and a second portion and for providing a second hinge line on said second plastic sheet member to enhance the folding memory of said second plastic sheet member along said second hinge line;

a first transverse folding means extending from said first side edge to said second side edge of said first plastic sheet member for providing a first transverse hinge line on said first plastic sheet member normal to said first hinge line to enhance the folding memory of said first plastic sheet member along said first transverse hinge line;

a second transverse folding means extending from said first side edge to said second side edge of said second plastic sheet member for providing a second transverse hinge line on said second plastic sheet member normal to said second hinge line to enhance the folding memory of said second plastic sheet member along said second transverse hinge line; and a valve means positioned in one of said first and said second plastic sheet members for permitting fluid communication of said inflating fluid into said chamber to define an inflated cushion and for further permitting fluid communication of said inflating fluid out of said chamber to define a collapsed and deflated cushion to enable in use said first folding means and said second folding means to be simultaneously folded along said first hinge line and said second hinge line, respectively, such that said first side edges of said first and said second plastic sheet members are proximate said second side edges of said first and said second plastic sheet members to form a flat, partially folded and deflated inflatable cushion and to further enable said first transverse folding means and said second transverse folding means to be simultaneously folded along said first and said second transverse hinge lines, respectively, such that said back edges of said first and said second plastic members are proximate said front edges of said first and said second plastic sheet members to form a flat, completely folded and deflated inflatable cushion.

2. The cushion of claim 1 further including a partition member disposed within said chamber to form a proximate chamber and a distal chamber within said chamber;

said partition further including a first end, a second end, a third end and a fourth end; and said first end and said second end of said partition member sealingly interconnect each said first and second sheet members, respectively, for maintaining a substantially parallel relationship of said first and second plastic sheet members when the cushion is inflated by said inflating fluid.

3. The cushion of claim 2 further including an aperture formed in said partition to enhance fluid communication of said inflating fluid between said proximal chamber and said distal chamber of said chamber.

4. The cushion of claim 2 further including a sixth folding means disposed on said partition and extending from said third end to said fourth end of said partition for providing a sixth hinge line to enhance the folding memory of said partition along said sixth hinge line and to enhance the collapsibility of the cushion when the cushion is being deflated in use.

5. The partition of claim 2 wherein said partition further includes a first and a second notch formed at said third end and said fourth end, respectively, for receiving in use a portion of said first interconnecting member and said second interconnecting member proximate said third end and said fourth end of said partition member, respectively, when the cushion is being deflated to thereby enhance the flatness of the cushion when completely collapsed and deflated.

6. The cushion of claim 1 wherein said folding means comprise a channel formed in said plastic sheet members to enhance the folding memory of said sheet members.

7. The cushion of claim 1 further including a hold down means for securing and maintaining the cushion in a deflated, collapsed and folded position.

8. The cushion of claim 1 wherein said first and second plastic sheet members further include a seventh and an eighth folding means, respectively;

said seventh folding means being parallel and spaced apart relative to said first folding means and further providing an seventh hinge line extending from said front edge to said back edge of said first plastic sheet member to enhance the folding memory of said first plastic sheet member along said seventh hinge line and to provide a third portion of said first sheet member; and said eighth folding means being parallel and spaced apart relative to said second folding means and further providing an eighth hinge line extending from said front edge to said back edge of said second plastic sheet member to enhance the folding memory of said second plastic sheet member along said eighth hinge line and to provide a third portion of said second sheet member to enable said first portions of said first and said second plastic sheet members to be simultaneously folded along said first and said second hinge lines provided by said first and said second folding means such that said first side edges of said first and said second plastic sheet members are proximate said seventh hinge line of said first plastic sheet member and to enable said third portions of said first and said second plastic sheet members to be simultaneously folded along said seventh and said eighth hinge lines provided by said seventh and eighth folding means such that said second side edges of said first and said second plastic sheet members are proximate said second hinge line provided by said second folding means of said second sheet member.

9. The cushion of claim 1 wherein said valve means further includes a sound generating means activated by the inflating fluid when the cushion is being deflated.

10. The cushion of claim 1 wherein each said folding means further includes a plurality of channels forming each hinge line to enhance collapsibility and foldability of the cushion.

11. The cushion of claim 1 wherein said first transverse folding means and said second transverse folding means each include a plurality of channels forming said first transverse hinge line and said second transverse hinge line, respectively, to enhance foldability of said first sheet member and said second sheet member, respectively.

12. An inflatable, deflatable and foldable cushion comprising:

a first and a second plastic sheet member having an outer surface and an inner surface;

said first and said second plastic sheet members having a front edge, a back edge, a first side edge and a second side edge;

a front interconnecting member having a first end, a second end, a third end and a fourth end;

said first end and said second end of said front interconnecting member sealingly interconnect said front edges of each said first and said second plastic sheet members, respectively;

a back interconnecting member having a first end, a second end a third end and a fourth end;

said first end and said second end of said back interconnecting member sealingly interconnect said back edges of each said first and said second plastic sheet members, respectively;

a first side interconnecting member having a first end, a second end, a third end and a fourth end;

said first end and said second end of said first interconnecting member sealingly interconnect each said first side edges of each said first and said second plastic sheet members, respectively;

a second side interconnecting member having a first end, a second end, a third end and a fourth end;

said first end and said second end of said second interconnecting member sealingly interconnect each said second side edges of each said first and said second plastic sheet members, respectively;

said third end of said front interconnecting member sealingly interconnected with said third end of said first interconnecting member;

said fourth end of said first interconnecting member sealingly interconnected with said third end of said back interconnecting member;

said fourth end of said back interconnecting member sealingly interconnected with said fourth end of said second interconnecting member;

said third end of said second interconnecting member sealingly interconnected with said fourth end of said front interconnecting member such that when inflated said inner surfaces of said first and said second plastic sheet members are in a substantially parallel spaced apart relationship and said front interconnecting member and said back interconnecting member are in a substantially parallel and spaced apart relationship and said first and said second interconnecting members are in a substantially parallel and spaced apart relationship to define a fluid tight chamber to receive an inflating fluid;

a third folding means extending from said third end of said back interconnecting member to said fourth end of said back interconnecting member for providing a third hinge line disposed on said back interconnecting member to enhance the folding memory of said back interconnecting member along said third hinge line;

a fourth foling means extending from said third end of said first side interconnecting member to said fourth end of said first interconnecting member for providing a fourth hinge line disposed on said first interconnecting member to enhance the folding memory of said first interconnecting member along said third hinge line;

a fifth folding means extending from said third end of said second side interconnecting member to said fourth end of said second interconnecting member for providing a fifth hinge line disposed on said second interconnecting member to enhance the folding memory of said second interconnecting member such that upon deflation of the cushion said third, fourth and fifth folding means permit the collapse of said inner surface of said first plastic sheet member onto said inner surface of said second plastic sheet member thereby forming a flat and collapsed cushion;

a valve means for permitting fluid communication of said inflating fluid into said chamber to define an inflated cushion and for further permitting fluid communication of said inflating fluid out of said chamber in order to provide a collapsed deflated cushion such that said first and said second plastic sheet members collapse to define a deflated flat cushion;

a first folding means extending from said front edge to said back edge of said first plastic sheet member thereby dividing said first plastic sheet member into a first portion and a second portion and for providing a first hinge line on said first plastic sheet member to enhance the folding memory of said first plastic sheet member along said first hinge line;

a second folding means extending from said front edge to said back edge of said second plastic sheet member thereby dividing said second plastic sheet member into a first portion and a second portion and for providing a second hinge line on said second plastic sheet member to enhance the folding memory of said second plastic sheet member along said second hinge line;

a first transverse folding means extending from said first side edge to said second side edge of said first plastic sheet member for providing a first transverse hinge line on said first plastic sheet member normal to said first hinge line to enhance the folding memory of said first plastic sheet member along said first transverse hinge line;

a second transverse folding means extending from said first side edge to said second side edge of said second plastic sheet member for providing a second transverse hinge line on said second plastic sheet member normal to said second hinge line to enhance the folding memory of said second plastic sheet member along said second transverse hinge line such that said first portion of said first and said second plastic sheet members may be simultaneously folded along said first and said second hinge lines of said first and second plastic sheet members, respectively, such that said first side edges of said first and said second plastic members are proximate said second side edges of said first and said second plastic sheet members to form a flat, partially folded and deflated inflatable cushion and to further enable said first and said second transverse hinge lines to be simultaneously folded to enable said back edges of said first and said second plastic sheet members to be positioned proximate said front edges of said first and said second plastic sheet members to thereby form a flat, completely folded and deflated cushion.

13. The cushion of claim 12 further including a partition member disposed within said chamber to form a proximate chamber and a distal chamber;

said partition member further including a first end, a second end, a third end and a fourth end; and said first end and said second end of said partition member sealingly interconnect each said first and second sheet members, respectively, for further maintaining said parallel relationship of said first and second plastic sheet members when the cushion is inflated.

14. The partition of claim 12 further including an aperture formed in said partition to enhance fluid communication of said inflating fluid between said proximal chamber and said distal chamber of said chamber.

15. The partition of claim 14 further including a sixth folding means extending from said third end to said fourth end of said partition for providing a sixth hinge line to enhance the folding memory of said partition along said sixth hinge line and to enhance the collapsibility of the cushion.

16. The partition of claim 12 wherein said partition further includes a first and a second notch formed at said third end and said fourth end, respectively, for receiving in use a portion of said first interconnecting member and said second interconnecting member proximate said third end and said fourth end of said partition member, respectively, when the cushion is being deflated to thereby enhance the flatness of the cushion when completely collapsed and deflated.

17. The cushion of claim 12 wherein each said third folding means, said fourth folding means and said fifth folding means are formed in said outer surface of said back interconnecting member, said first interconnecting member and said second interconnecting member, respectively, to enhance the inwardly foldability and collapsibility of said back interconnecting member, said first interconnecting member and said second interconnecting member thereby enhancing the foldability and collapsibility of the cushion when deflated.

18. The cushion of claim 12 wherein said first folding means is formed in said outer surface of said first plastic sheet member and said second folding means are formed in said inner surface of said second plastic sheet member to enhance the foldability of said first portions of said first and said second plastic members along said first and second hinge lines of said first and said second plastic sheet members.

19. The cushion of claim 12 wherein each said folding means further includes a plurality of channels to form each said hinge line to enhance collapsibility and foldability of the cushion.

20. The cushion of claim 12 wherein said first folding means providing said first hinge line is a first channel formed in said outer surface of said first plastic sheet member and said second folding means providing said second hinge line is a second channel formed in said inner surface of said second plastic sheet member thereby further enhancing the foldability of the cushion when said first portions of said first and said second plastic sheet members are simultaneously folded along said first and said second hinge lines of said first and second plastic sheet members, respectively.

21. The cushion of claim 12 wherein said third, fourth and fifth folding means provide said third, fourth and fifth hinge lines are third, fourth and fifth channels formed in said outer surface of said back interconnecting member, said first interconnecting member and said second interconnection member, respectively, to inwardly bias said interconnecting members when in use the cushion is being deflated.

22. The cushion of claim 12 wherein said first and second plastic sheet members further include a seventh and an eighth folding means, respectively;

said seventh folding means being parallel and spaced apart relative to said first folding means and further providing an seventh hinge line extending from said front edge to said back edge of said first plastic sheet member to enhance the folding memory of said first plastic sheet member along said seventh hinge line and to provide a third portion of said first sheet member; and said eighth folding means being parallel and spaced apart relative to said second folding means and further providing an eighth hinge line extending from said front edge to said back edge of said second plastic sheet member to enhance the folding memory of said second plastic sheet member along said eighth hinge line and to provide a third portion of said second sheet member to enable said first portion of said first and said second plastic sheet members to be simultaneously folded along said first and said second hinge lines provided by said first and said second folding means such that said first side edges of said first and said second plastic sheet members are proximate said seventh hinge line of said first plastic sheet member and to enable said third portions of said first and said second plastic sheet members to be simultaneously folded along said seventh and said eighth hinge lines provided by said seventh and eighth folding means such that said second side edges of said first and said second plastic members are proximate said second hinge line provided by said second folding means of said second sheet member.

23. The cushion of claim 22 wherein each said seventh folding means is a seventh channel formed in said outer surface of said first plastic sheet member and said eighth folding means is an eight channel formed in said inner surface of said second plastic sheet member to enhance foldability of said first and said plastic sheet members along said seventh and said eighth hinge lines, respectively.

24. The cushion of claim 12 wherein said valve means further includes a sound generating means activated by the inflating fluid when the cushion is being deflated.

25. The cushion of claim 12 wherein said third end and said fourth end of each of said front interconnecting member, said back interconnecting member, said first interconnecting member and said second interconnecting member are concavely shaped to further enhance an inwardly folding direction of said back interconnecting member, said first interconnecting member and said second interconnecting member.

26. The cushion of claim 12 further including a hold down means for securing and maintaining the cushion in a deflated, collapsed and folded position.

27. The cushion of claim 12 wherein said first transverse folding means and said second transverse folding means each include a plurality of channels forming said first transverse hinge line and said second transverse hinge line, respectively, to enhance foldability of said first sheet member and said second sheet member, respectively.

* * * * *

UNITED STATES PATENT AND TRADEMARK OFFICE

CERTIFICATE OF CORRECTION

PATENT NO. : 4,774,735

DATED : October 4, 1988

INVENTOR(S) : Zinn et al.

It is certified that error appears in the above-identified patent and that said Letters Patent are hereby corrected as shown below:

In the Specification

Column 1, line 12, delete "deflection" and insert therefor --deflation--.

Column 3, line 27, delete "eah" and insert therefor --each--.

Column 4, line 23, delete "holding" and insert therefor --folding--.

Column 4, line 60, after "further" insert --provides--.

Column 5, line 47, after "the" (second occurence) insert --first--.

Column 7, line 23, delete "deflected" and insert therefor --deflated--.

Column 7, line 53, after "of" insert --folding means which provide hinge lines and the number of transverse--.

Column 11, line 4, after "member" insert --66, the first interconnecting member 94 and the second interconnecting member--.

In the Claims

Column 18, line 8, delete "foling" and insert therefor --folding--.

UNITED STATES PATENT AND TRADEMARK OFFICE

CERTIFICATE OF CORRECTION

PATENT NO. : 4,774,735

DATED : October 4, 1988

INVENTOR(S) : Zinn et al

It is certified that error appears in the above-identified patent and that said Letters Patent is hereby corrected as shown below:

Column 20, line 46, after "plastic" insert --sheet--.

Signed and Sealed this

Twenty-fifth Day of April, 1989

*Attest:*

*Attesting Officer*

DONALD J. QUIGG

*Commissioner of Patents and Trademarks*